United States Patent [19]

Balz

[11] 3,981,693

[45] Sept. 21, 1976

[54] FINISHING APPARATUS

[75] Inventor: Gunther W. Balz, Kalamazoo, Mich.

[73] Assignee: Roto-Finish Company, Kalamazoo, Mich.

[22] Filed: Nov. 12, 1973

[21] Appl. No.: 414,656

[52] U.S. Cl. ..... 51/163.2
[51] Int. Cl.[2] ..... B24B 31/06
[58] Field of Search ..... 51/7, 163

[56] References Cited

UNITED STATES PATENTS

| | | | |
|---|---|---|---|
| 3,422,577 | 1/1969 | McKebber | 51/163 |
| 3,423,884 | 1/1969 | Balz | 51/163 |
| 3,464,163 | 9/1969 | Ferrara | 51/7 |
| 3,611,638 | 10/1971 | Deede | 51/163 X |
| 3,792,552 | 2/1974 | Isaacson | 51/163 X |

FOREIGN PATENTS OR APPLICATIONS

| | | | |
|---|---|---|---|
| 959,849 | 6/1964 | United Kingdom | 51/163 |

*Primary Examiner*—Harold D. Whitehead
*Attorney, Agent, or Firm*—Gordon W. Hueschen

[57] ABSTRACT

A machine for finishing parts, having part-isolating means such as vertical partitions or dividers, defining one or more compartments, disposed at least partially within the finishing chamber, each compartment designed to accept a part or parts to be finished and to maintain parts isolated from other parts. The finishing chamber and the part-isolating means are movable with respect to each other. As a result, as the part moves along the finishing chamber during the course of the finishing process, the compartment defined by the part-isolating means, e.g., partitions, moves longitudinally with the part and isolates it from other parts. In one embodiment of the invention, the part-isolating means, such as partitions for defining compartments for the parts, also moves vertically or pivotally with respect to the finishing chamber, e.g., to clear rises therein. Thus, in effect, the compartment surrounding the part and isolating it from other parts, moves with the part. In all embodiments the partitions are arranged to move longitudinally with the parts, and means are provided for retarding or stopping the parts longitudinally. Means is provided for separating finishing material from the parts and discharging finished parts. The finishing machines may be curvilinear or annular gyratory motion-type machines, linear tub-type machines, or any of various types of tumbling machines.

30 Claims, 21 Drawing Figures

128
139
130
131
140
146
146
129
126
135
143
133
134
132
142
136
137
127

146
145
144
138
130
146
141
139
131
146
146
140
142
146
143
133
134
146
137
136

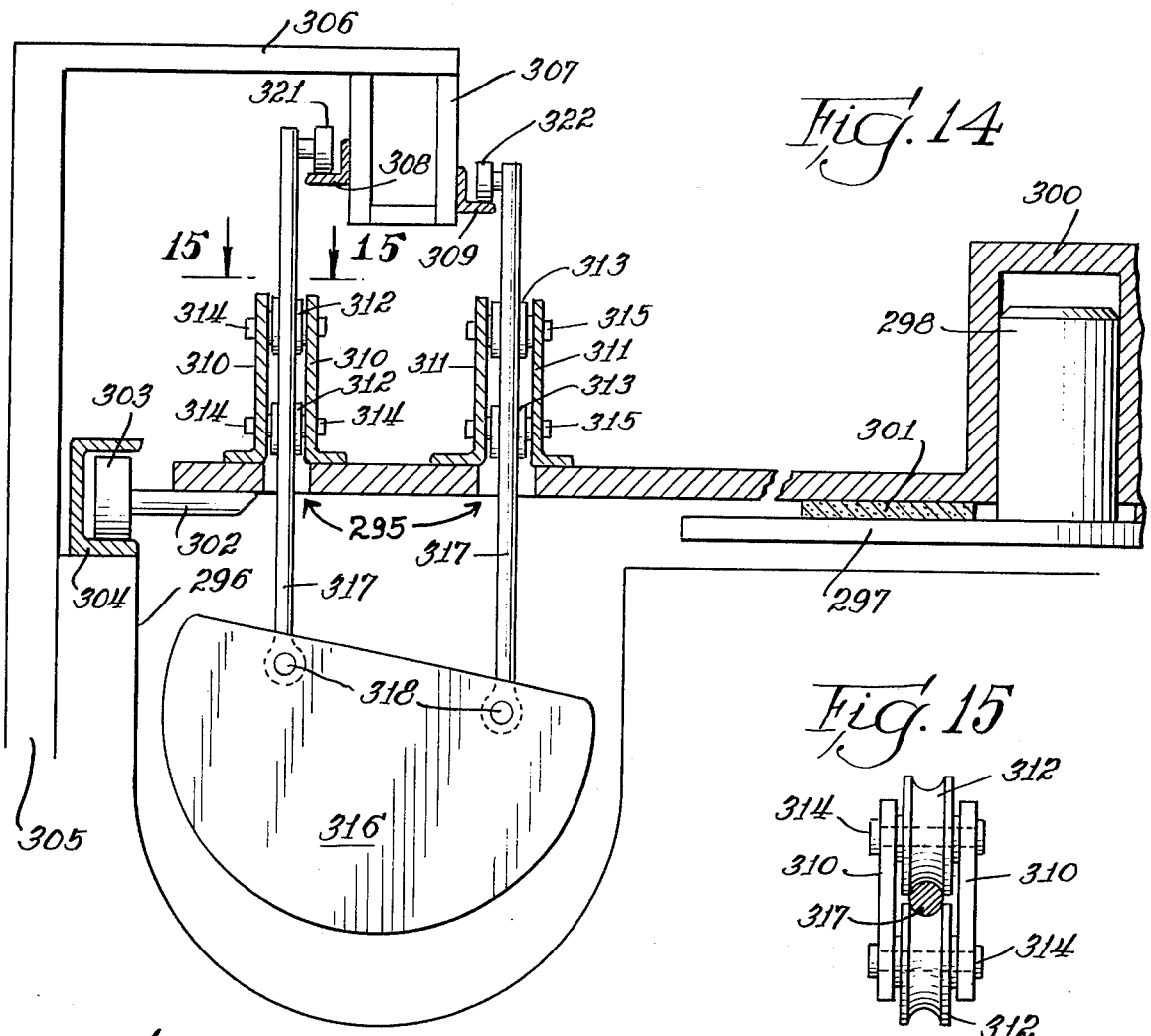
Fig. 14
Fig. 15
Fig. 16
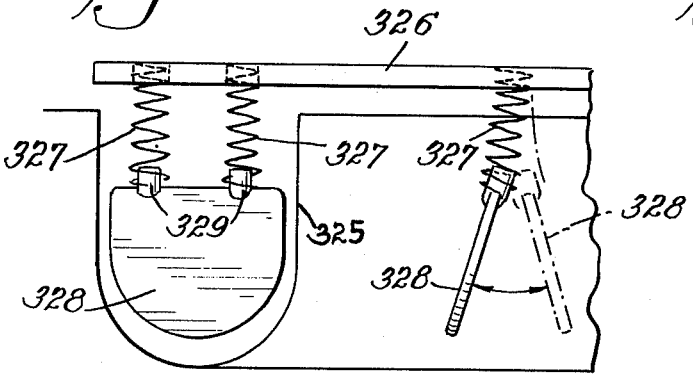
Fig. 17
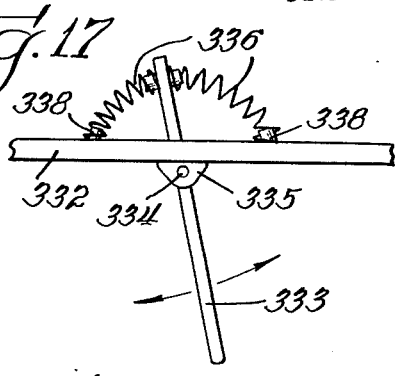
Fig. 18
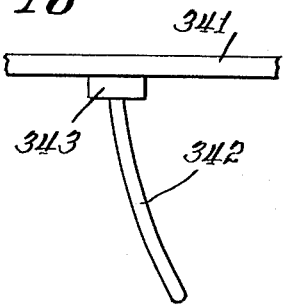
Fig. 19
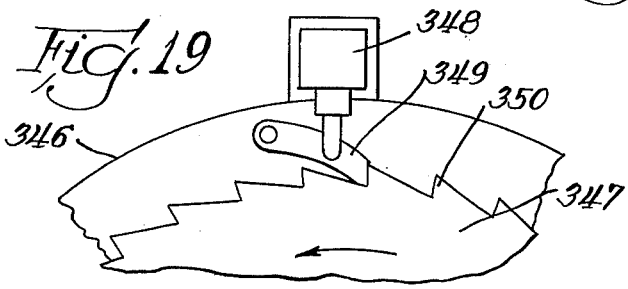

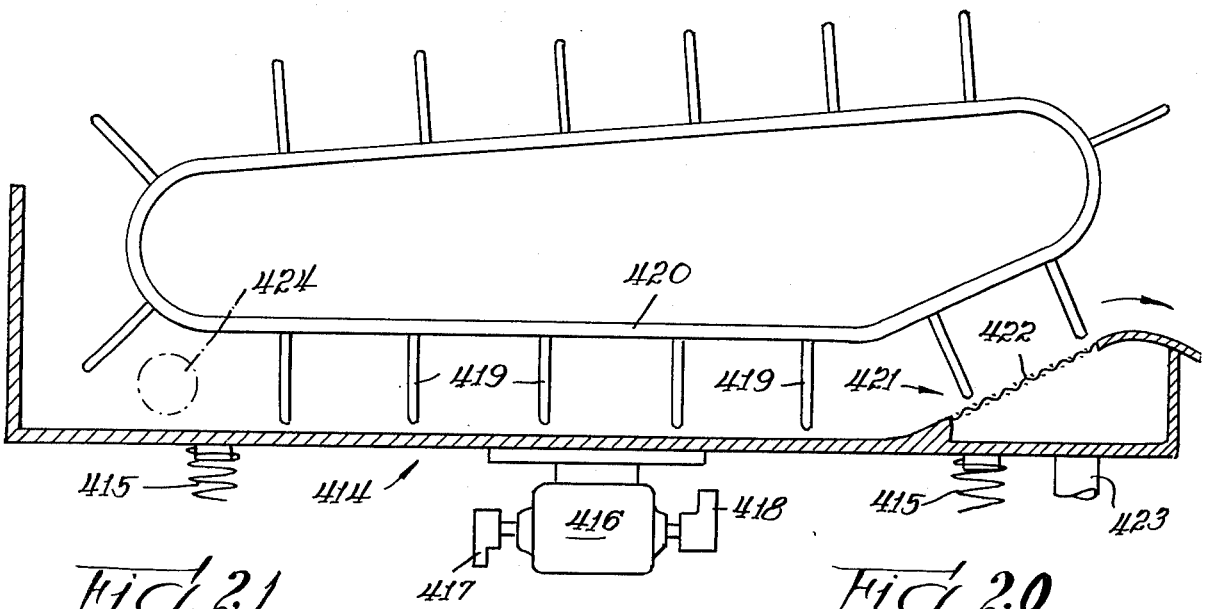
Fig. 21
Fig. 20
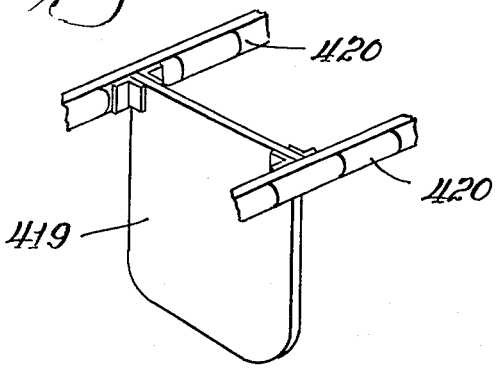

FINISHING APPARATUS

BACKGROUND OF THE INVENTION

1. Field of Invention

The present invention relates to finishing machines, being especially adapted for use in or with vibratory finishing machines and particularly those having a curvilinear finishing chamber and vertically oriented gyratory motion-producing assembly and power driving means.

2. Prior Art

Finishing machines and especially vibratory finishing machines are well known in the art. Such machines are used for various forms of finishing, such as burr removal, burnishing, and polishing. Such machines are disclosed and claimed in U.S. Pat. Re. Nos. 27,084, 3,400,495, 3,423,884, 3,435,564, 3,466,815, 3,606,702, and 3,633,321. Machines of the type described generally have a finishing chamber and a motor operatively mounted with respect to the chamber and arranged to cause eccentric weights to rotate or revolve, thereby producing vibratory motion of the finishing chamber. In one form disclosed in the prior art, a tub-type of finishing chamber, usually linear, has a motor with eccentric weights mounted on the shaft of the motor directly mounted to the tub, or a shaft with eccentric weights mounted to the tub and motor driven. In another type, the eccentric weights are mounted out of phase on a vertical shaft, causing the finishing chamber which is generally curvilinear to undergo gyratory motion. In either type, as a result of the vibratory movement, when materials such as parts and/or finishing materials are placed in the chamber, orbital motion is imparted to the contents so that they move upwardly at the peripheral portion of the chamber and downwardly at the inner portion of the chamber. This results in relative movement between the finishing material and parts, or at least interaction therebetween, causing the parts to be finished. Additionally, by employment of a proper phase relationship between the eccentric or unbalance weights, varying degrees of precession or linear progression of the material and parts are cuased circumferentially around the annular finishing chamber, or linearly in the tub-type, as is well-known in the art. Various forms of guides or vanes, including helical guides, have also been fixed internally of a finishing chamber to assist with such precession. See, for example, U.S. Pat. No. 3,071,900.

Prior art finishing machines, e.g., tumbling machines and vibratory finishing machines, such as described above, generally function well. However, they all suffer from at least one disadvantage. During the finishing process, there is a tendency for closely adjacent parts to collide with each other as a result of the tumbling or vibrational movement imparted to them, often resulting in considerable damage to the parts by denting or fracture. In U.S. Pat. No. 3,423,884, a finishing apparatus is disclosed wherein the entire finishing machine may be mounted for rotation by an adjoining motor and belt assembly. The finishing chamber is divided into a plurality of compartments which are stationary with respect to the finishing chamber, the entire assembly if desired rotating during the finishing process. This apparatus succeeds in isolating high precision and easily damageable parts so that they are safely finished. However, no unloading means have been provided or suggested for such machine and it is necessary that each part be unloaded by hand. The cost of labor utilized in manually loading of parts, separating parts from finishing media, and hand removal of finished parts from the finishing machine is extremely high, if not prohibitive. Finishing machines have also been devised utilizing spindles, wherein the parts are fixtured to a spindle during the finishing process. The cost of manually mounting the parts and removing them in such devices is also prohibitively high. Floating compartment devices are also known, but these are no better than fixed compartment machines and suffer from the same disadvantages as previously noted., e.g., the necessity of manual loading and separation and the high cost of labor associated therewith in the absence of any suggestion of automatic separation and how it might be effected in such devices.

As known in the art, parts-finishing cycle control or adjustment has been effected by controlling the phase relationship of the eccentric weights on the shaft driven by the motor. U.S. Pat. Nos. 3,435,564 and 3,466,815 show means for making such adjustment. This is a partially satisfactory way of operation, but it has the limitations that it does not permit precise or exact control of the parts-finishing cycle, and further, that it does not keep the parts evenly distributed in the finishing chamber. The method and apparatus of the present invention, on the other hand, does permit precise and exact control of the parts-finishing cycle, and does permit isolation of parts from other parts to prevent damage to the parts as a result of collision between them.

OBJECTS OF THE INVENTION

It is accordingly an object of the present invention to provide a finishing apparatus wherein parts-isolating means are provided for maintaining parts, which are particularly subject to damage by collision with adjacent parts isolated from other parts. It is an additional object to provide a finishing apparatus of the type described wherein the parts to be finished are permitted to move with respect to the chamber while still maintaining parts isolated from other parts. It is still an additional object to provide such an apparatus having means for automatically discharging the parts from the finishing chamber when the parts have been sufficiently finished. It is still another object to provide an apparatus for finishing parts while maintaining them isolated from other parts, which can utilize any of the commonly utilized methods of finishing parts. It is another object to provide means for maintaining parts in isolated condition during the finishing process, which apparatus can be readily adapted to existing conventional finishing apparatus. It is an additional object to provide a means for exact control of the finishing cycle by controlling the speed of the moving part, which permits exact timing of part entry, part exit, and time during which the parts remain in the machine during the finishing cycle, whereby the timing cycle can be so precisely controlled that the process may be synchronized to other machines operated in conjunction with the finishing machine. It is another object to provide a finishing machine of the type described in which the part-isolating means and finishing chamber move with respect to each other and whereby the finished parts are automatically separated, if desired after a precisely-timed finishing cycle, and if desired with automatic return of separated finishing material to the finishing chamber for reuse. It is still another object to provide a finishing machine of the type described which embodies part-isolating means which also move vertically or pivotally with respect to the finishing chamber. Still other objects will readily present themselves to one skilled in the art upon reference to the ensuing specification, drawings and claims.

BRIEF DESCRIPTION OF THE DRAWINGS

In the drawings,

FIG. 14 is a fragmentary sectional view showing still another modified embodiment of the partition and supporting structure.

FIG. 15 is a fragmentary cross-sectional view taken at the line 15—15 of FIG. 33, looking in the direction of the arrows.

FIG. 16 is a fragmentary cross-sectional view showing another embodiment of the partition structure and its support.

FIG. 17 is a fragmentary cross-sectional view showing still another embodiment of the partition and support.

FIG. 18 is a fragmentary cross-sectional view showing another embodiment of the partition.

FIG. 19 is a fragmentary plan view showing the structure for controlling the speed of the turntable of the apparatus of the embodiments of the invention.

FIG. 20 is an elevational view, partly in cross-section, showing a further embodiment of the invention utilizing a chain support for the part-isolating means.

FIG. 21 is a fragmentary perspective view showing a part-isolating partition and a portion of its supporting chain.

DESCRIPTION OF THE PREFERRED EMBODIMENTS

Figure 1:
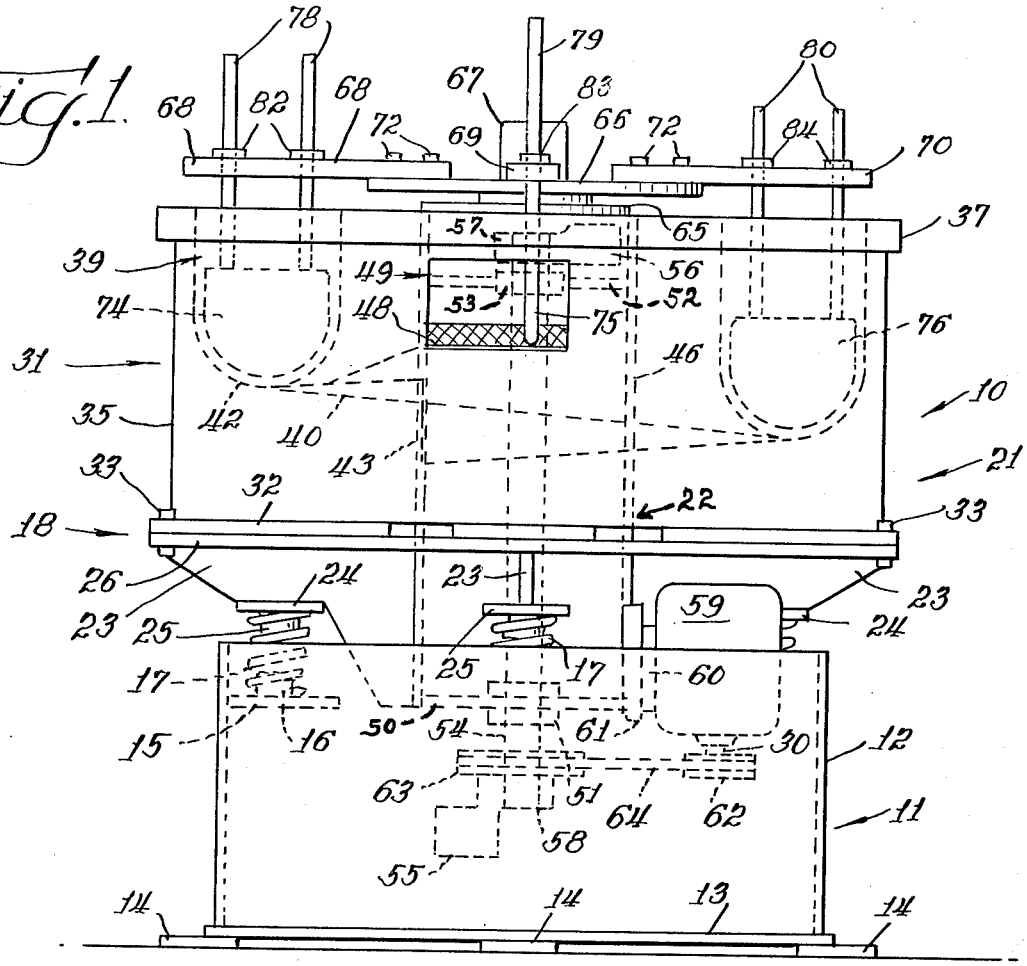
FIG. 1 is an elevational view of a finishing machine according to the invention.
Figure 2:
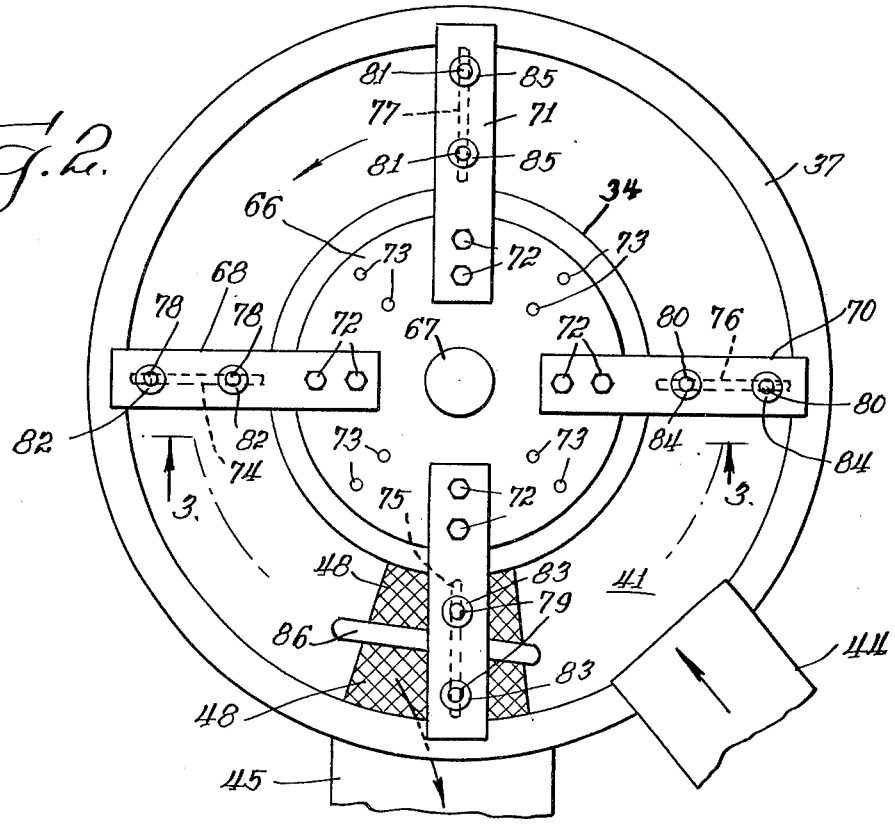
FIG. 2 is a top plan view of the finishing machine shown in FIG. 1.

Referring to FIGS. 1–4, a vibratory finishing apparatus 10 is shown comprising a fixed base 11 having a cylindrical wall 12, a bottom 13, square foot plates 14, and a radially directed annular flange 15. Spring-engaging protuberances 16 are affixed to the flange 15 for engaging one end of coil springs 17. Alternatively, a resilient material such as rubber or other elastic materials may be utilized in place of coil springs.

A floating supporting assembly 21 comprises a central tubular gyratory motion-producing assembly 22 and sheet-form radial supports 23. The radial supports 23 have square plates 24 affixed thereto on one edge which are provided with spring-engaging protuberances 25 on the other surfaces of the plates which engage the upper ends of the coil springs 17. Horizontal radial supporting arms 26 are affixed to the radial supports 23 by means such as welding. The radial supports 23 and the radial supporting arms 26 are welded to each other and to the central tube assembly 22.

Mounted on the floating support assembly 21 is an annular finishing chamber or tub assembly 31. The finishing chamber assembly 31 has four horizontally disposed radial arms 32 of substantially the same size and shape and which are detachably affixed to the radial supporting arms 26 by means of bolt and nut assemblies 33. Affixed to the radial arms 32 by means such as welding are an inner vertically arranged tubular finishing chamber support 34 and an outer vertically arranged tubular finishing chamber support 35. An annular channel-form rim 37 is affixed to the outer support 35 by means such as welding in order to reinforce the structure. An annular finishing chamber or tub 39 is disposed intermediate the supports 34 and 35 and affixed thereto by welding.

The central gyratory motion-producing assembly 22 comprises a vertically oriented tubular housing 46 affixed by welding at a lower portion thereof to the radial supports 23 and the radial supporting arms 26. The annular finishing chamber 39 may be any of a large number of different sizes and shapes. The chamber shown in FIGS. 1 and 2 has an arcuate bottom 42 and is in the form of a single turn helix, having a discharge zone 40 in one portion and a loading zone 41 in another. A vertical wall 43 separates the lowest portion of the bottom from the highest. Alternatively, finishing chambers having a horizontally arranged bottom or a helical bottom of more than one turn may be utilized. With such structures various separating devices known in the art may be utilized for removing the parts and returning the finishing material to the starting portion of the chamber.

Mounted in the lower portion of the tubular housing 46 is a lower bearing support plate 50 having a bearing 51 mounted thereon and an upper bearing plate 52 having a bearing 53 mounted thereon. An eccentric weight-supporting shaft 54 is rotatably journaled in the bearings 51 and 53 and has an arm 58 affixed to the end thereof supporting an eccentric or unblance weight 55. An upper eccentric or unbalance weight 56 is mounted at the other end of the shaft 54 on an arm 57 affixed to the shaft.

A motor 59 is mounted by means of a sliding base 60 and mounting plate 61 on the outer surface of the tubular housing 46 at the lower end thereof. The motor shaft 30 has a pulley 62 affixed thereto which is operatively connected to a pulley 63 mounted on the shaft 54 by means of an endless flexible belt 64.

Figure 3:
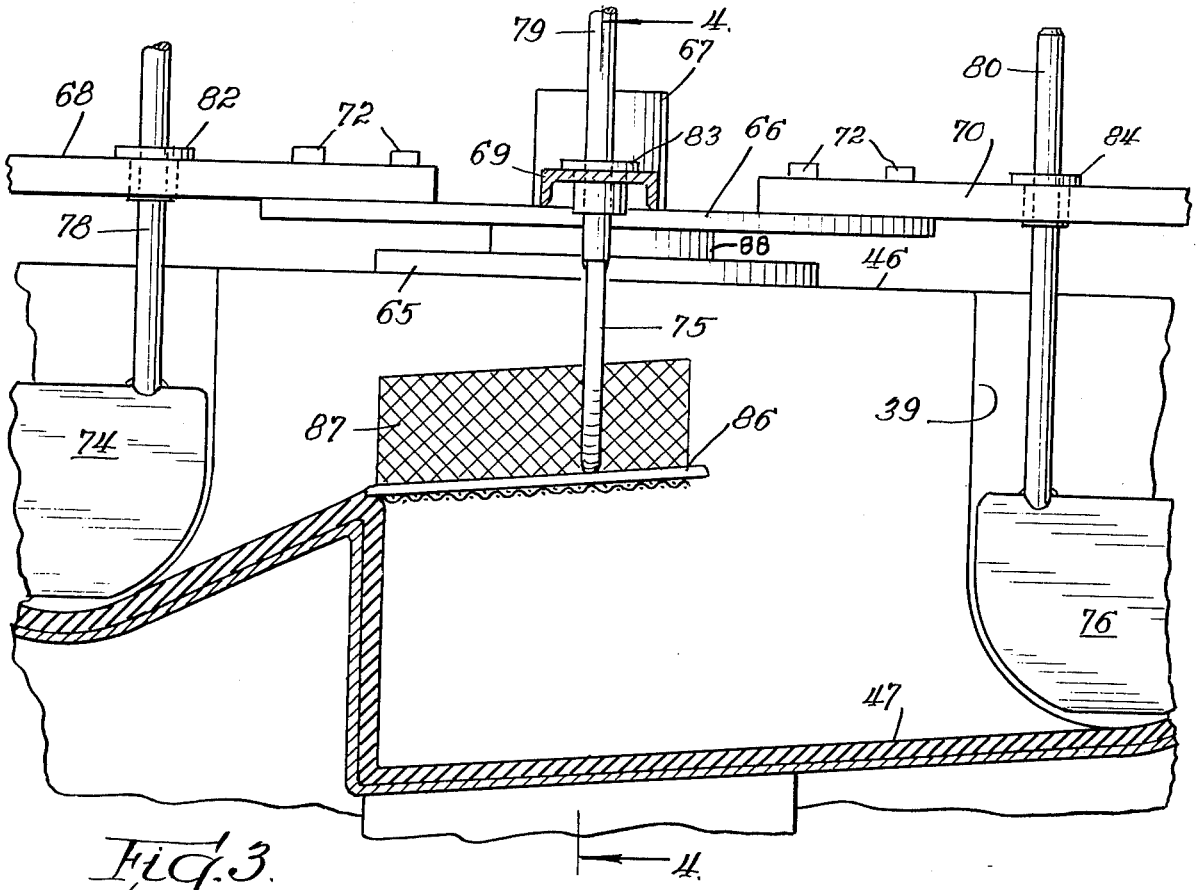
FIG. 3 is a fragmentary sectional view taken at the line 3—3 of FIG. 2, looking in the direction of the arrows.
Figure 4:
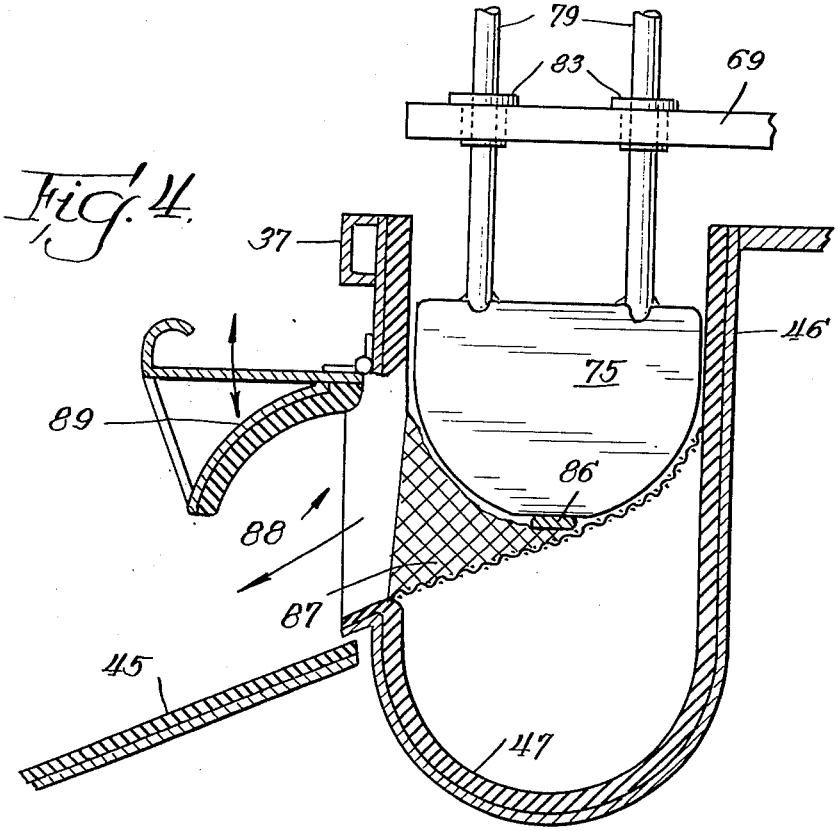
FIG. 4 is a fragmentary cross-sectional view taken at the line 4—4 of FIG. 3, looking in the direction of the arrows.

The structure for defining compartments movable with respect to the finishing chamber is shown in FIGS. 1-4 and in greater detail in FIGS. 3 and 4. The structure comprises a pedestal 65 mounted on the cylindrical support 46 and having a vertical spindle and a bearing 88 mounted thereover. A turntable 66 is rotatably mounted on the spindle. A cap 67 affixed to the turntable is journaled over the spindle. Radial arms 68, 69, 70, and 71 are mounted on the turntable 66 by means of bolts 72. Additional holes 73 are provided for mounting additional radial arms or for repositioning the existing radial arms. Partitions or separators 74, 75, 76, and 77 are provided with vertical guide rods 78, 79, 80, and 81, the partitions being affixed to one end of the rods. Bushings 82, 83, 84, and 85 slidably receive the rods 78, 79, 80, and 81, respectively. Although not absolutely necessary, a rail 86 (FIG. 4) may be provided to guide the partitions 74–77 along the bottom of the finishing trough and over the separating screen 87. Magnetic separator or vacuum separator means may be employed in place of foraminous member 87 if desired. An exit port 88 is provided for discharging finishing parts, and is maintained closed during the finishing operation by means of a door 89 and throughout as many recycles of the finishing operation as may be desired. An exit trough 45 may be utilized to guide discharged parts to a suitable receptacle or assembly line (not shown).

In placing the embodiment of FIGS. 1–4 into operation, the finishing material is loaded into the finishing chamber 39. The parts are then loaded into the finishing chamber, one or more parts being placed in each compartment intermediate each pair of partitions, for example in the compartment between 75 and 76. Additional parts may be placed one in each of the remaining compartments. The electric motor 59 is then activated, causing the finishing chamber to undergo gyratory motion, and thereby causing the parts and finishing material to engage in orbital motion in the arcuate chamber, and additionally to undergo precession upwardly in a circumferential direction along the trough of the finishing chamber. Since the partitions 74-77 are supported on a freely rotating turntable, they revolve passively in the chamber together with the parts, maintaining each part separated from every other part, thereby preventing damage by collision. The lower arcuate portions of the partitions ride on the bottom of the trough, and where a rail 86 is utilized, on the rail itself. As the partitions proceed along the inclined bottom of the trough, they are elevated, the vertical guide rods 78, 79, 80, and 81 rising within the inserts, thereby guiding the partitions radially and longitudinally while permitting them to rise vertically. When the partitions rise to the uppermost portion of the finishing chamber and clear the screen 87 and the vertical wall 43, they are then permitted to drop to the lower portion 41 of the trough under the influence of gravity. The parts proceed through one or more finishing cycles, as desired, and are then discharged through the discharge exit and fresh parts are loaded into the empty compartments. The separated media drops through the screen for reuse in another cycle. The operation is the same regardless of the exact type of separating means employed.

Figure 5:
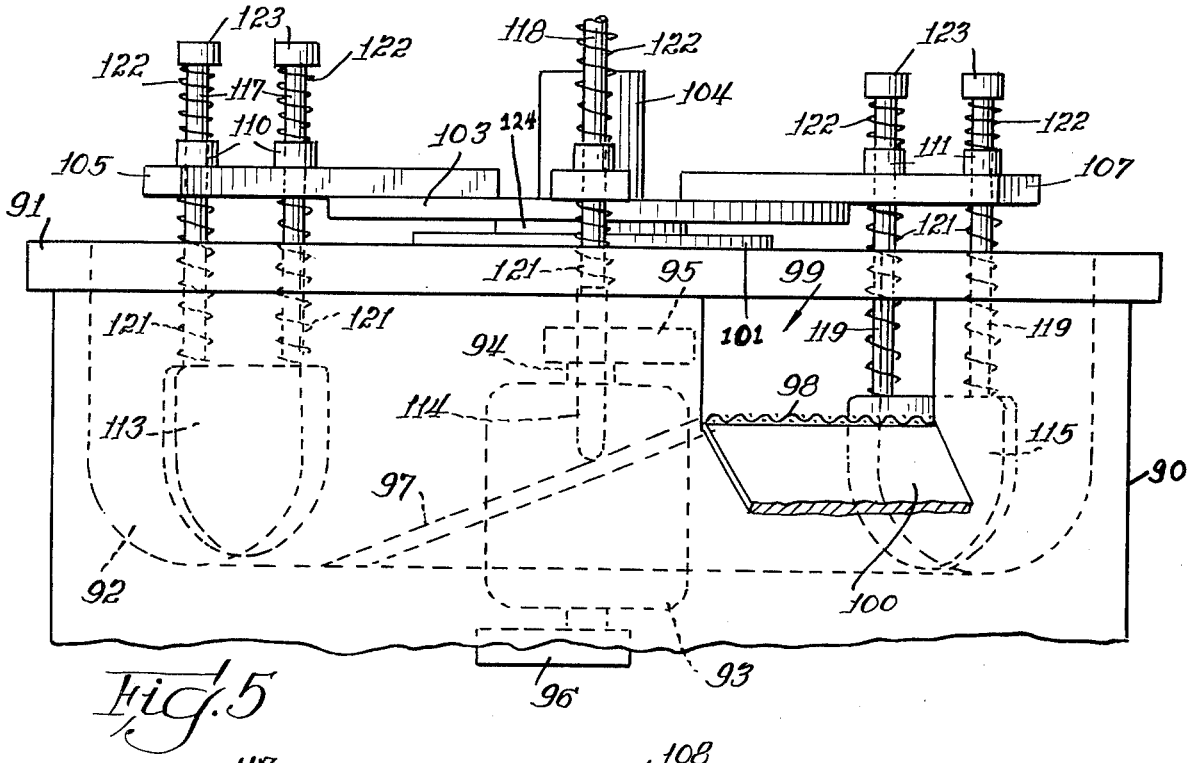
FIG. 5 is a fragmentary elevational view of another embodiment of the invention.
Figure 6:
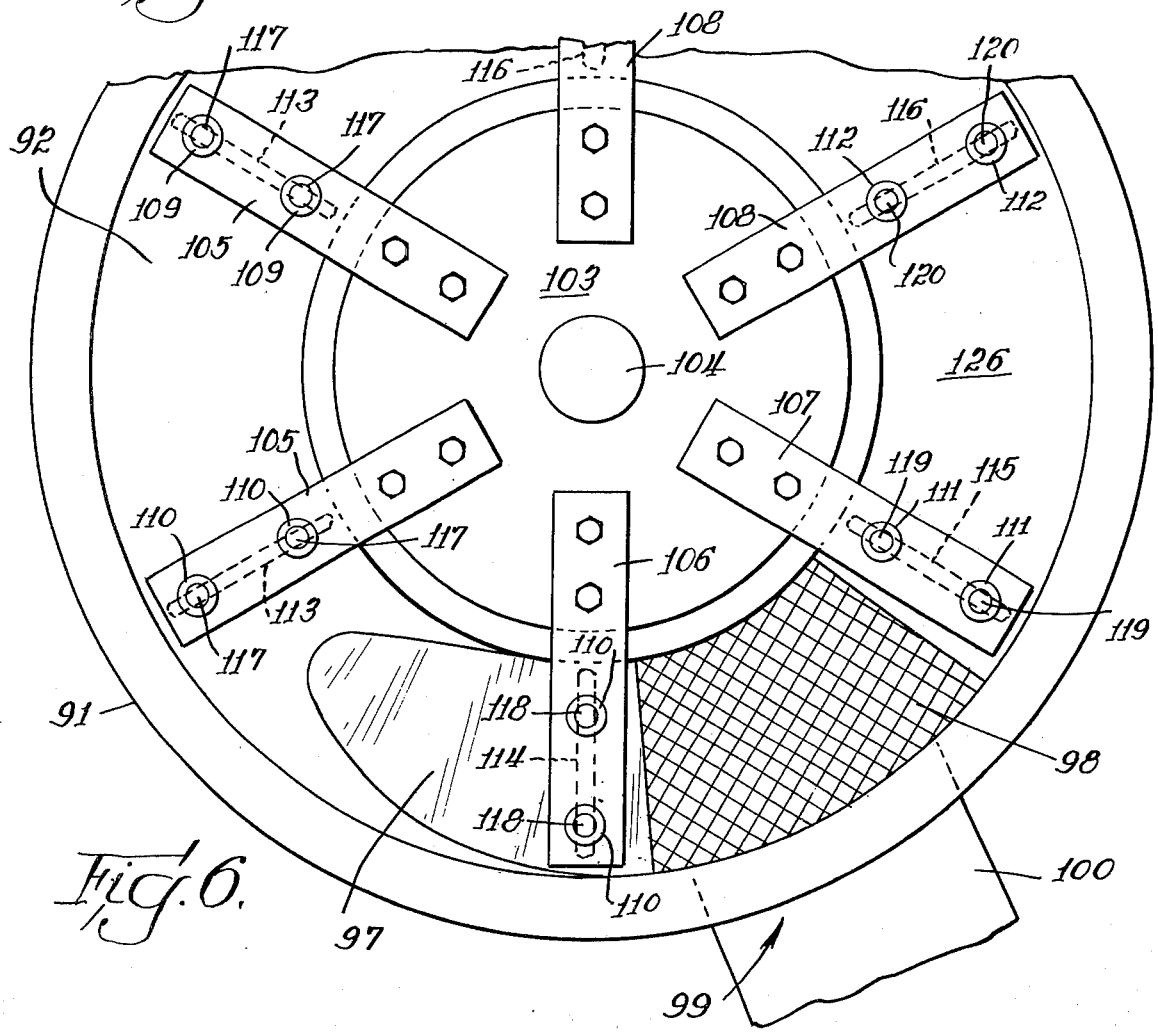
FIG. 6 is a fragmentary top plan view of the apparatus shown in FIG. 5.

Referring to FIGS. 5 and 6, another embodiment of the invention is shown. A portion of the structure is basically the same as that shown in FIGS. 1-4, and therefore only the structural portion which is different is shown. In addition to the structure shown in FIGS. 1-4, the structure of FIGS. 5 and 6 comprises a finishing chamber support 90 having a channel-type rim 91 and an annular finishing chamber 92 having a horizontal bottom. A motor 93 is supported by a portion of the finishing chamber support (not shown) and is provided with a shaft 94 having eccentric or unbalance weights 95 and 96 affixed to the ends thereof. In order to discharge parts, a ramp 97 is provided terminating in a separation screen 98 leading to an exit port 99 and an exit trough 100. Although not shown, a door similar to that shown in FIG. 4 may be utilized to close the exit port during operation.

The means for isolating parts during the finishing process comprises a pedestal 101 affixed to the floating frame of the finishing apparatus (not shown). The pedestal is provided with a vertical spindle (not shown) affixed thereto over which is mounted a bearing 124 and a turntable 103. A cup 104 affixed to the turntable 103 is journaled over the spindle. Affixed to the turntable 103 are radial arms 105, 106, 107, and 108 by means of bolts. Bushings 109, 110, 111 and 112 are mounted on the radial arms. Partitions 113, 114, 115 and 116 are provided with vertical guide rods 117, 118, 119 and 120, respectively, affixed at their ends to the partitions, and are in turn slidably journaled through the respective bushings 109, 110, 111 and 112. The vertical guide rods 117, 118, 119 and 120 are provided with lower biasing springs 121 and upper biasing springs 122. Caps 123 screwingly engage the vertical guide rods and retain the upper biasing.

In operation, parts and finishing material are charged into the finishing chamber in the portion shown on the right-hand side of FIGS. 5 and 6. The motor is caused to rotate causing gyratory motion which causes the parts and finishing material to vibrate with an orbital motion and additionally to proceed counter-clockwise as shown in FIG. 6. Each part is placed in a compartment 125 defined by the partitions 113 and 114 and in the compartment 126 defined by the partitions 115 and 116. The precessional movement of each part and media pushes against the partition in front of it and causes the turntable to rotate with the parts, thereby maintaining the parts in their individual compartments as they proceed during the finishing process. When they reach the ramp 97, the parts and finishing material rise along the ramp onto the screen 98. Here the finishing material passes through the screen and continues its travel along the finishing chamber while the part is discharged through the exit port 99 into the exit trough 100. When each partition reaches the ramp the springs 121 are compressed and the springs 122 permitted to extend, permitting the partitions to rise up the ramp and onto the screen. After the partitions pass the screen, they drop again to the bottom of the trough and are maintained there by the force of the lower springs 121. The upper springs 122 are provided to counter balance the lower springs 121 so that the partitions have an equilibrium point at or near their position at the bottom of the trough.

Figure 7:
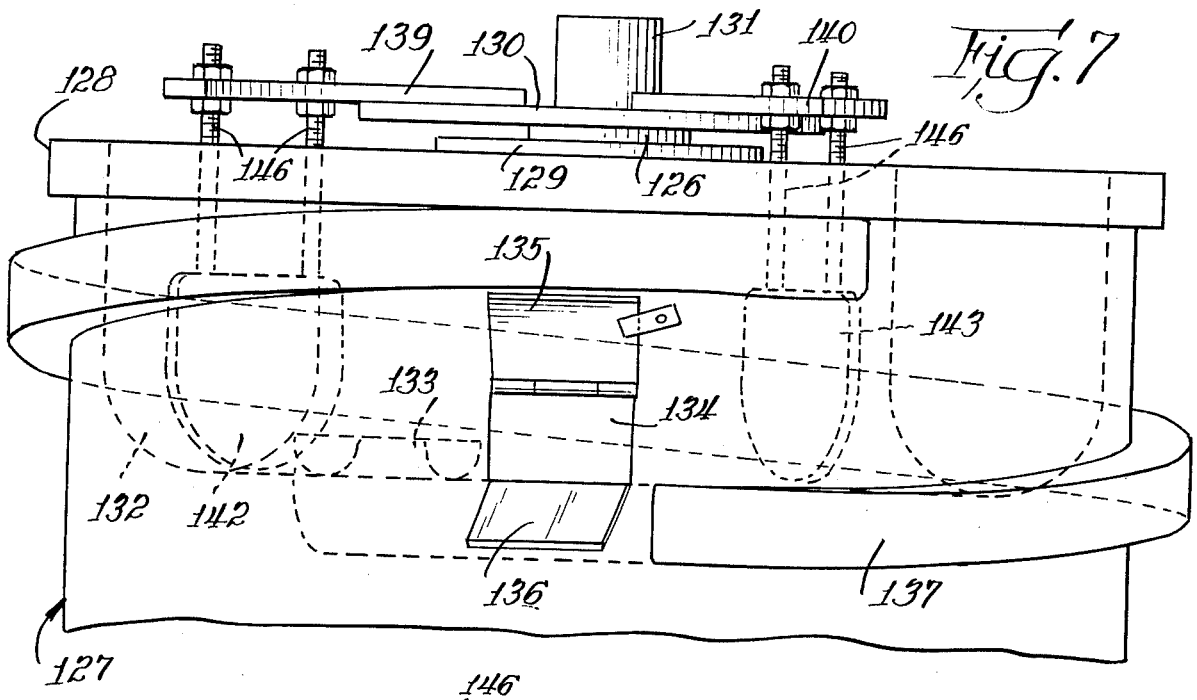
FIG. 7 is a fragmentary side elevational view of another embodiment of the invention.
Figure 8:
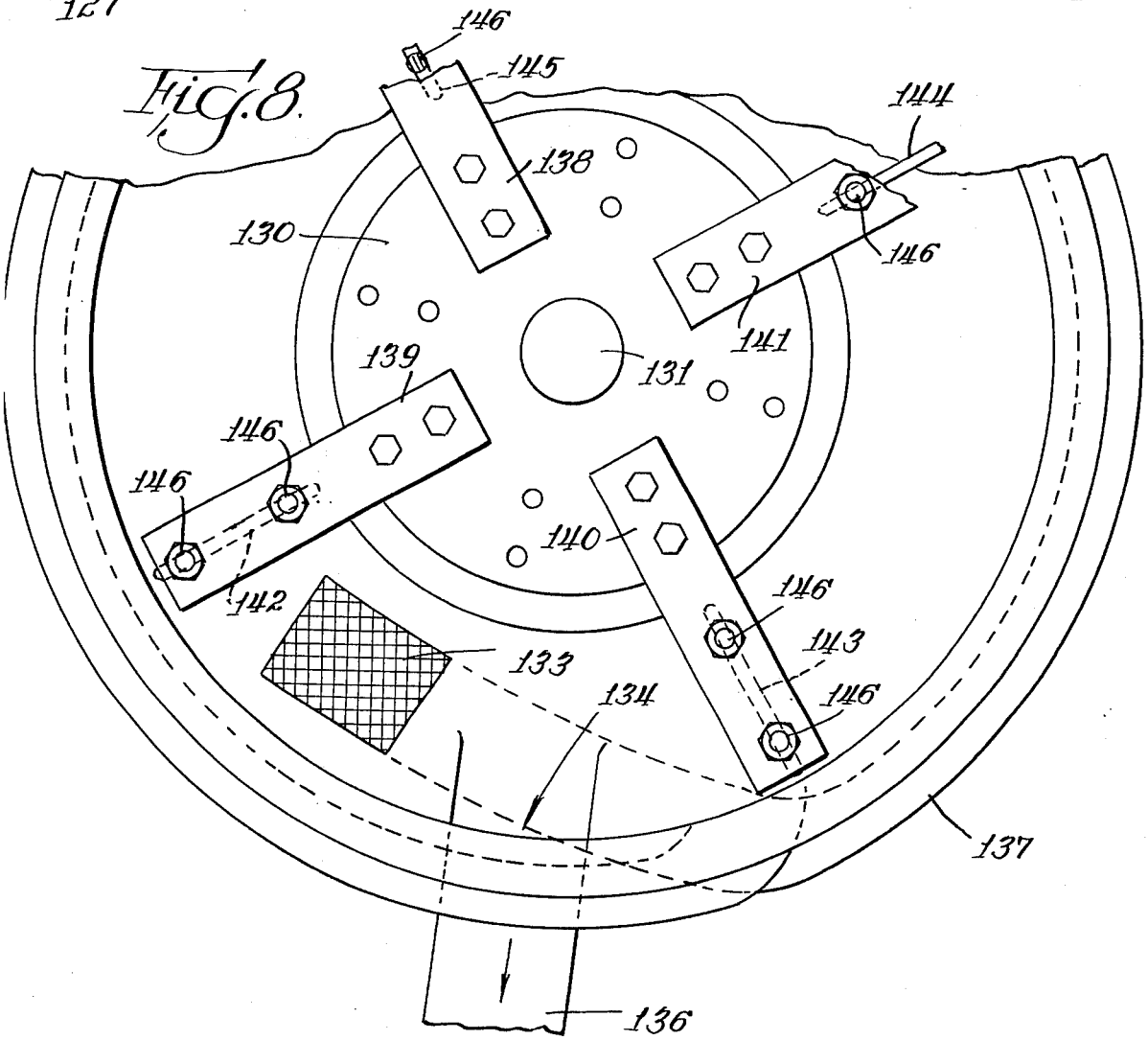
FIG. 8 is a fragmentary top plan view of the embodiment shown in FIG. 7.

Referring to FIGS. 7 and 8, still another embodiment is shown. The apparatus is provided with a chamber-supporting frame 127 mounted and vibrated by equipment similar to that shown in FIGS. 5 and 6, and having a rim 128. The part-isolating structure is similar to that shown in the previous figures, and comprises a pedestal 129 supported on the frame 127 having a vertical spindle similar to that shown in the previous drawings but not shown. A bearing 126 is mounted on the spindle and over the bearing is mounted a turntable 130 having a cap 131 journaled over the spindle. The annular finishing chamber 132 has a horizontal bottom with a trough-form screen 133 for separating finishing material. The chamber 132 is provided with an exit port 134 to discharge parts which is closed by a door 135 during the finishing operation. The separated parts are discharged through the exit port onto the exit ramp 136, and the finishing media which passes through the screen 133 is returned along a media return tube 137 back to the finishing chamber.

The compartmentalization structure comprises radial arms 138, 139, 140 and 141 affixed by bolts to the turntable 130. Part-isolating partitions 142, 143, 144 and 145 are affixed to vertical guide rods 146 which are in turn bolted to the radial arms 138, 139, 140 and 141 by means of bolts. Because the bottom of the finishing trough 132 is horizontal and has no ramp, the partitions undergo no vertical motion, and therefore the vertical guide rods 146 are permanently affixed to the radial arms by screw nuts.

In the embodiment of FIGS. 7 and 8, the finishing process proceeds as that described above with respect to the apparatus of FIGS. 5 and 6, the partitions forming compartments around each part so that it cannot collide with an adjacent part. When the finishing process is complete, the door 135 is opened, discharging the parts, the finishing material is returned through the material return tube 137 and the partitions continue to revolve. Alternatively, any of a number of known external auxiliary conveyors and separators may be utilized to separate the finishing material and return it to the starting or loading portion of the chamber.

Figure 9:
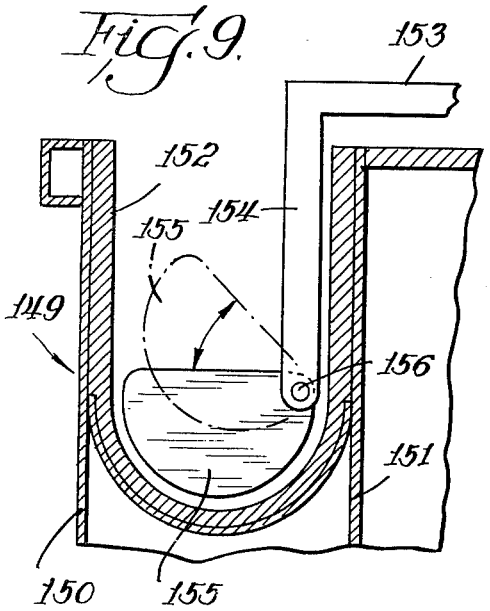
FIG. 9 is a fragmentary cross-sectional view showing an alternative means for raising the partitions of the present invention.

Referring to FIG. 9, a modified form of part-isolating apparatus is shown, mounted in a finishing machine 149 having walls 150 and 151 supporting a finishing chamber 152 in the form of an annular trough. The portion of the apparatus shown comprises a turntable 153 rotatably mounted similarly to that shown in the previous figures having a plurality of vertical supporting arms 154 affixed at one end to the turntable and extending into the finishing chamber 152. Semi-circular partitions 155 are pivotally mounted to the lower end of the supporting arm 154 by conventional means such as rivets 156. During the finishing process adjacent partitions define compartments in each of which a part to be finished is placed. As the parts and finishing material are caused to proceed along the trough, they engage and push the partitions 155 and cause them to move with the part, thereby maintaining the part isolated from other parts throughout the finishing process. If a ramp and separating screen is used, the partition pivots upwardly to clear the ramp while still maintaining the parts separated. When the ramp is cleared, the partition pivots downwardly to engage the bottom of the trough again.

Figure 10:
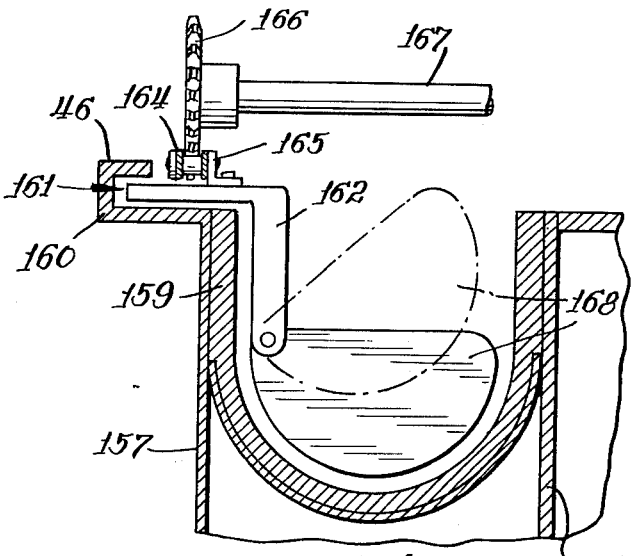
FIG. 10 is a fragmentary cross-sectional view showing still another embodiment utilized for raising and supporting the partitions of the present invention.

FIG. 10 illustrates a portion of a finishing apparatus having supporting walls 157 and 158 and an annular finishing chamber 159. At the rim of the supporting wall 57 a J-form flange 160 is provided defining a slot 161. An L-shaped supporting arm 162 has a horizontal arm slidably positioned in the slot. A chain 164 is affixed to the horizontal arm by means of a corner mounting bracket 165. The chain is coupled to a sprocket 166 mounted on a shaft 167. Partitions 168 are pivotally connected to the vertical portion of the arm 162.

In operation the basic portion of the finishing machine operates in similar manner as described with regard to the previous embodiment. The apparatus for maintaining the parts separated may be utilized in one of several different procedures. In one method of operation, the sprocket may be free-running, or even omitted, the chain then serving solely to support the partitions for movement. In this method the movement of the parts drives the partitions along at the same rate of precession as the parts while still maintaining the parts separated. In still another method of operation, the sprocket may be coupled to a control such as a solenoid or ratchet which either retards the sprocket or else stops it completely at the desired positions or time intervals, thereby providing additional control of the finishing process. Further, all methods may be made available by combining the motor, stopping means or retarding means in the same apparatus.

Figure 11:
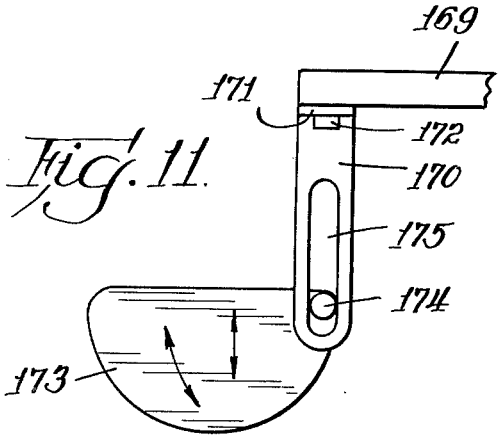
FIG. 11 is a fragmentary view of another embodiment of the invention showing a partition and supporting member.
Figure 12:
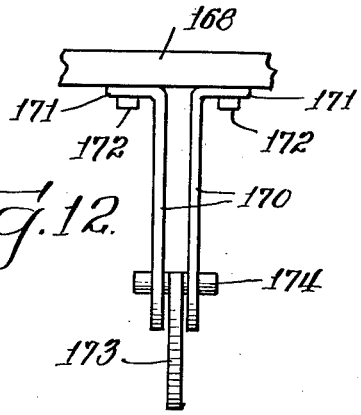
FIG. 12 is an elevational view taken at the line 12—12 of FIG. 11, looking in the direction of the arrows.

FIGS. 11 and 12 illustrate a portion of a part-isolating apparatus comprising a turntable 169 and a vertical support comprised of a pair of spaced-apart vertical arms 170 affixed to the turntable by means of feet 171 secured by bolts 172. A partition 173 is mounted on the vertical arm by means of a pin 174 affixed to one corner of the partition and riding in slots 175 provided in the vertical arms 170. The structure permits the partitions to rise, fall, or pivot when encountering any obstruction such as ramp or discharge mechanism.

Figure 13:
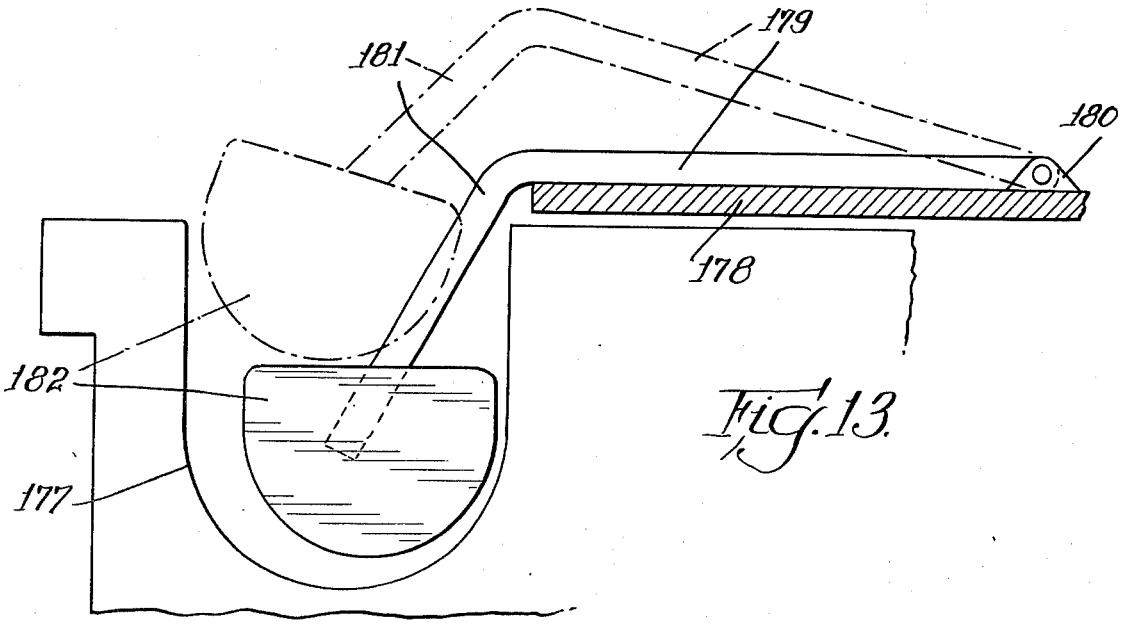
FIG. 13 is a fragmentary sectional view showing still another embodiment of the invention.

FIG. 13 illustrates an annular finishing trough 177 in conjunction with which is mounted a turntable 178 having a horizontal arm 179 pivotally mounted thereto by means of supporting ears 180 and a pivot pin. The horizontal arm 179 is provided with an offset end 181 which is affixed at its end to a partition 182. The structure is so arranged that when a ramp or other obstruction is encountered, the partition and its supporting structure are raised to clear the ramp or obstruction.

In FIGS. 14 and 15, there is shown still another embodiment of the compartment-forming apparatus of the invention. In this embodiment a conventional annular finishing chamber 296 is shown having conventional supporting equipment. Mounted on the supporting equipment is a pedestal 297 having a vertical spindle 298. Mounted over the spindle are a bearing 301 of either sliding or frictionally retarding material and a turntable 299 having a cap 300 affixed thereto journaled over the spindle 298. The turntable 299 is provided with apertures 295. An axle 302 is affixed to the end of the turntable and is provided with a roller 303 which is engaged in a channel-form track 304. A vertical support 305 is mounted on the finishing apparatus and is provided with a horizontal arm 306. A track-support beam 307 is affixed to the end of the horizontal arm 306 and is provided with an outside track 308 and an inside track 309 affixed thereto. Roller supports 310 and 311 are affixed to the turntable and are provided with four pairs of concave rollers 312 and 313 mounted on shafts 314 and 315 retained in the roller supports 310 and 311. A partition 316 is supported by vertical guide rods 317 pivotally affixed thereto by hinge pins 318. The upper ends of the vertical guide rods 317 are provided with rollers 321 and 322 which engage the tracks 308 and 309.

During normal operation of the finishing machine, the turntable 299 rotates with its roller 303 engaged in the track 304. The tracks 308 and 309 may be so designed that the partitions are raised in order to clear inclined portions of the finishing chamber or discharge ramps. It may also be arranged to lower the partitions when the lower portion of the finishing chamber is reached. The concave rollers permit the vertical guides to raise and lower easily without bending.

FIG. 16 shows a modified structure for supporting the partitions. A finishing chamber 325 has a turntable 326 mounted thereover in manner described above. Affixed to apertures in the turntable are a plurality of springs 327. Partitions 328 have lugs 329 affixed thereto engaging the other ends of the coil springs 327. During operation the partitions are maintained in proper position at the bottom of the trough to separate adjacent parts. When an inclined portion of the finishing chamber or a ramp is encountered, the partition is bent rearwardly as shown in the drawing to permit the partition to clear the elevated structure.

FIG. 17 shows still another method of clearing an inclined portion of a finishing chamber or a ramp. In this structure a turntable 332 is provided with a partition 333 which is provided with a pin 334 engaging apertures in a pair of ears 335. Coil springs 336 are engaged by lugs 337 provided on the partition ends and lugs 338 provided on the turntable. When an incline or ramp or other obstruction is encountered, the partition is pushed rearwardly until it clears the obstruction, returning to its vertical position after the obstruction has been cleared.

FIG. 18 illustrates an embodiment wherein the turntable 341 is provided with a flexible partition 342 affixed to the turntable 341 by means of a retainer 343. The partition 342 may be fabricated from natural or synthetic rubber, various flexible plastic materials, or flexible metals which are preferably coated with an elastic material such as neoprene. During the finishing operation as the partition encounters an incline or ramp, the partition is bent rearwardly, raising its lower portion over the obstacle while still maintaining the parts isolated.

FIG. 19 illustrates a structure for controlling the speed of rotation of the turntable or for stopping it entirely at any desired point of time and for any desired period. Shown are a conventional finishing chamber support 346 and a turntable 347 rotatably mounted thereover. The periphery of the turntable is in the form of a ratchet 350 and a pawl 349 is pivotally mounted on the chamber support 346. A solenoid 348 is externally controlled and raises or lowers the pawl to control the rotation of the turntable.

Referring to FIGS. 20 and 21, a different embodiment of the invention is shown comprising a linear finishing chamber 414 in the form of a linear trough having an arcuate bottom. The trough is mounted for vibration on a plurality of springs 415 which are in turn mounted on a fixed base (not shown). A motor 416 having eccentric weights 417 and 418 is mounted to the bottom of the finishing chamber, with the weights mounted on the motor shaft. These weights may be either in or out of phase with each other, depending upon whether the trough is or is not slanted toward its outlet. Within the chamber 414 are a plurality of partitions 419 connected to a chain 420. The chain 420 is commonly known as a self-supporting chain and has a structure so arranged that each link can bend only to horizontal in one direction and to a predetermined minimum radius in the other direction. Consequently, the upper flight of the chain is self-supporting and need not be supported on rollers or sprockets. The chain is similar to that disclosed in U.S. Pat. Nos. 3,448,953, 3,448,954, 3,503,578, 3,503,579, and 3,504,864. In operation, the vibration produced by the motor and eccentric weights causes the parts and finishing material to encounter orbital action transversely to the finishing chamber and also precession forwardly along the finishing chamber. This causes the parts to bear on the partitions 419 and to move them forward. As the partitions reach the forward portion of the apparatus they encounter a ramp 421 and a separating screen 422. The finishing material falls through the screen and is separated from the part, and returns through a duct 423 to an opening 424 in the starting portion of the finishing chamber.

By "finishing material" or "finishing media" or "medium," as these terms are used herein, it is intended to include loose, comminuted, granular, or particulate, and in any event, solid finishing materials of the type which are presently employed in the trade and any others of a similar nature. Although liquid finishing materials may be used in conjunction with the solid finishing material these are considered to be ancillary for purposes of the present invention which in all cases employs at least some solid finishing medium for the process of the invention. Moreover, the terms first set forth in this paragraph are used herein generally to designate such solid materials which are used to impart all types of finishes including those finishes acquired with abrading materials as well as with polishing materials, and "polishing" is to be considered in its usual sense as one species of "finishing."

As used herein in the specification and claims, the term "compartment" denotes the spacial configuration defined by surfaces of adjacent part-isolating means of the invention and within which spacial configuration or area the part or parts are positioned. In the embodiment where the part-isolating means comprises a plurality of transverse partitions, the "compartment" is defined by the surfaces of adjacent partitions and by the sides and bottom of the finishing chamber. In all the above embodiments, the walls of the part-isolating means move longitudinally with the compartment in which the part or parts are positioned.

The finishing apparatus of the present invention has many advantages over conventional equipment shown in the art. There is presently no apparatus disclosed which is able to finish precision machine parts or large parts and wherein the parts may be introduced automatically and removed automatically. Currently available equipment utilizes a spindle-type abrasive deburring machine with the part to be finished fixtured on a spindle. This involves loading, unloading, and a special fixture for each part. This technique can also be employed with a rotating barrel or a vibrating tub, either round or straight-line, but the disadvantages are the same.

The primary advantage offered by the present invention is that finishing machines may be utilized which have automatic loading and automatic unloading and still, by means of the various forms of the present invention which define individual compartments for each precision part to be finished, the parts are maintained separated from all other parts and ultimately automatically discharged. Additionally, the present invention permits more sophisticated and precision control of the time cycle and dwell time of the parts within the finishing chamber. Following are some of the advantages of the present invention:

1. Absolutely controlled and reproducable time cycles.

2. Processing of either large or small parts.

3. Complete isolation of one part(s) from other part(s) to eliminate nicking or scratching of parts.

4. Exact distribution of parts in available capacity of machine.

5. Improved automatic separation of parts from media because the part is in the separation zone at a known time for a known period.

6. Automatic loading and unloading of the machine by conveyor devices from and to other machines made possible because of the precision control of the time cycle and part location.

The basic principle of the invention and the apparatus disclosed may additionally be applied to any type of tumbling mass machine either vibrational or rotational.

The precision capabilities of the machine are made possible by the fact that the partitions or other means defining compartments may be permitted to move passively with the parts and finishing material, or may be retarded to any desired degree or may even be stopped for a predetermined or desired period.

It is to be understood that the invention is not to be limited to the exact details of operation or structures shown and described, as obvious modifications and equivalents will be apparent to one skilled in the art.

I claim:

1. A finishing machine suitable for finishing the surfaces of parts with loose finishing material while maintaining a part or parts isolated from other parts and to prevent damage to parts as a result of collision therebetween, said finishing machine comprising:

a. a resiliently supported finishing chamber, 2. means for imparting vibratory movement to said finishing chamber to cause the parts contained therein to be finished by interaction with said finishing material and to move along said chamber, 3. part-isolating means defining at least two compartments in said finishing chamber arranged to contain a part or parts therein and to maintain said part or parts isolated from other parts in said finishing chamber, 4. wherein said part-isolating means comprises partitions arranged for movement along said finishing chamber and adapted to be carried along by the contents of the finishing chamber, 5. wherein said part-isolating means also comprises support means mounted for movement with respect to said finishing chamber, said partitions being supported by said support means, said support means being arranged to guide said partitions along said finishing chamber with said contents of the finishing chamber, 6. wherein said finishing chamber is annular, and 7. wherein said support means comprises a turntable.

2. Apparatus of claim 1, wherein said finishing chamber comprises a discharge zone and separating means is operatively associated with said finishing chamber for separating finished parts from finishing material when said finished parts are in said discharge zone.

3. A finishing machine of claim 2, including means for returning finishing material separated from finished parts by said separating means to said finishing chamber.

4. A finishing machine according to claim 2, wherein said means for separating finished parts comprises a ramp for raising said parts and finishing material, and a screen for separating said finishing material, said means arranged to conduct said parts to a discharge exit.

5. A finishing machine according to claim 2, wherein the bottom of said finishing chamber is horizontal, a screen is provided in the bottom of said finishing chamber at a discharge portion thereof for separating said finishing material from said parts, and comprising means for returning said separated finishing media to the finishing chamber and discharge means for discharging said parts.

6. A finishing machine according to claim 1, wherein said means for imparting movement to said finishing chamber is a gyratory motion-producing assembly resiliently supported for gyrational motion and having unbalance weights in such phase relationship with respect to each other so as to provide precessional motion of said parts and finishing material in said finishing chamber, and said finishing chamber is a substantially horizontally oriented annular trough operatively affixed to said gyratory motion-producing assembly.

7. A finishing machine according to claim 1, wherein said support comprises a plurality of arms and partitions, each partition having at least one vertical support member guided by said arms.

8. A finishing machine according to claim 7, wherein said arms are mounted on a turntable.

9. A finishing machine according to claim 7, wherein each arm is provided with at least one aperture having a vertical support of a partition slidably disposed therein.

10. A finishing machine according to claim 7, wherein said vertical supports are affixed to said arms.

11. A finishing machine according to claim 9, wherein springs are provided to bias said vertical support members to a fixed rest position.

12. A finishing machine according to claim 9, wherein a plurality of concave rollers are provided on said arms for guiding said vertical support members of said partitions.

13. A finishing machine according to claim 9, wherein said vertical support members are provided with cam follower means, and cam means is provided on said finishing chamber for cooperating with said cam follower means for lifting and lowering said partitions.

14. A finishing machine according to claim 1, wherein said support additionally includes a vertical support arm and said partitions are pivotally mounted at the end of said support arm.

15. A finishing machine according to claim 14, wherein said vertical support arms are provided with slots and said partitions are provided with pivot pins engaged in said slots.

16. A finishing machine according to claim 1, wherein said support is provided with an arm hinged therein having an offset portion affixed to said partitions.

17. A finishing machine according to claim 1, wherein said partitions are resiliently mounted on said support and adapted to be pushed rearwardly to clear rises in the bottom of said finishing chamber.

18. A finishing machine according to claim 1, wherein said part-isolating means is also adapted to move generally vertically or pivotally with respect to said finishing chamber to clear rises in said finishing chamber.

19. A finishing machine according to claim 18 including means for separating finished parts which comprise a ramp for raising said parts and finishing material and a screen for separating said finishing material, said means being arranged to conduct said parts to a discharge exit, said part-isolating means being mounted so as also to allow upward or pivotal movement thereof to permit said part-isolating means to clear said ramp, and wherein said means for imparting movement to said finishing chamber is a gyratory motion-producing assembly resiliently supported for gyrational motion and having unbalance weights in such phase relationship with respect to each other as to provide precessional motion.

20. Apparatus of claim 1, wherein said turntable is supported for vibratory movement with said finishing chamber.

21. Apparatus of claim 2, wherein said separating means, said finishing chamber, and said part-isolating means are arranged with respect to each other so as to permit individual separation of a part or parts contained in a compartment defined by said partitions when said compartment is in said discharge zone.

22. Apparatus of claim 1, wherein means are provided for retarding or stopping said turntable.

23. Apparatus of claim 22, wherein said turntable is timingly controlled.

24. Apparatus of claim 1, wherein said finishing chamber has a rise in its bottom.

25. Apparatus of claim 1, wherein said finishing chamber has a substantially horizontal arcuate bottom.

26. Apparatus of claim 2, wherein said separating means is internal of said finishing chamber.

27. Apparatus of claim 2, wherein said separating means is external of said finishing chamber.

28. A finishing machine according to claim 1, comprising means for controlling movement of said part-isolating means with respect to said finishing chamber.

29. A finishing machine according to claim 28, wherein said means for controlling movement comprise latch means adapted to be timingly controlled.

30. A finishing machine according to claim 28, wherein said means for controlling movement comprise ratchet and pawl means, and means for timingly actuating said pawl.

* * * * *

UNITED STATES PATENT OFFICE
CERTIFICATE OF CORRECTION

Patent No. 3,981,693 Dated September 21, 1976

Inventor(s) Gunther W. Balz

It is certified that error appears in the above-identified patent and that said Letters Patent are hereby corrected as shown below:

On the cover sheet, Item [56], "McKebber" should read --- McKibben ---.

Column 1, line 44, "cuased" should read --- caused ---.

Column 4, line 56, "unblance" should read --- unbalance ---.

Column 11, line 32, "a. a resiliently" should read --- 1. a resiliently ---.

Column 3, line 45, "of FIG. 33" should read --- of FIG. 14 ---.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*